US007299948B2

(12) United States Patent
Walton et al.

(10) Patent No.: US 7,299,948 B2
(45) Date of Patent: Nov. 27, 2007

(54) RESERVOIRS FOR BOTTLED LIQUID DISPENSERS

(75) Inventors: Philip Andrew Walton, Bishop Auckland (GB); Clyde Pittaway, Darlington (GB); Gary Squire, Bishop Auckland (GB)

(73) Assignee: EBAC Limited (GB)

( * ) Notice: Subject to any disclaimer, the term of this patent is extended or adjusted under 35 U.S.C. 154(b) by 225 days.

(21) Appl. No.: 10/539,184

(22) PCT Filed: Dec. 19, 2003

(86) PCT No.: PCT/GB03/05586

§ 371 (c)(1),
(2), (4) Date: Jun. 16, 2005

(87) PCT Pub. No.: WO2004/056696

PCT Pub. Date: Jul. 8, 2004

(65) Prior Publication Data

US 2006/0112718 A1 Jun. 1, 2006

(30) Foreign Application Priority Data

Dec. 23, 2002 (GB) ..... 0229752.1

(51) Int. Cl.
*B67D 5/63* (2006.01)

(52) U.S. Cl. ..... 222/146.5; 220/592.26

(58) Field of Classification Search ..... 62/389–400; 220/592.26, 592.27, 592.17; 222/146.5; 392/441–464

See application file for complete search history.

(56) References Cited

U.S. PATENT DOCUMENTS

| | | | | |
|---|---|---|---|---|
| 2,504,916 | A * | 4/1950 | Zolot | 222/131 |
| 2,857,084 | A | 10/1958 | Harris | |
| 3,541,808 | A | 11/1970 | Materese | |
| 4,320,856 | A * | 3/1982 | Stewart et al. | 222/131 |
| 4,675,508 | A * | 6/1987 | Miyaji et al. | 219/437 |
| 4,865,014 | A * | 9/1989 | Nelson | 122/19.2 |
| 5,540,355 | A | 7/1996 | Inn et al. | |
| 5,619,856 | A | 4/1997 | Lee | |
| 5,979,709 | A | 11/1999 | Liccioni | |
| 6,098,844 | A | 8/2000 | Nicolle | |

FOREIGN PATENT DOCUMENTS

| | | |
|---|---|---|
| GB | 1004498 | 9/1965 |
| GB | 2304179 | 3/1997 |

OTHER PUBLICATIONS

International Search Report Apr. 2, 2004.

* cited by examiner

*Primary Examiner*—William E. Tapolcai
(74) *Attorney, Agent, or Firm*—Ira S. Dorman

(57) ABSTRACT

A thermally-insulated reservoir 9 for a dispenser in which liquid is supplied from a bottle to a discharge outlet via a reservoir, has an inner wall 23 and an outer wall 24 defining a sealed and evacuated heat-insulating cavity 30 at least partially surrounding a liquid space 22. In one application of the invention the reservoir takes the form of a cooling vessel with the thermal means provided by a cooling coil 26. The invention may also be applied to reservoirs which form a hot tank with the thermal means provided by an electrical heating element.

6 Claims, 5 Drawing Sheets

RESERVOIRS FOR BOTTLED LIQUID DISPENSERS

TECHNICAL FIELD OF THE INVENTION

This invention relates to bottled liquid dispensers.

BACKGROUND

EP 0 581 491 A discloses a known form of bottled liquid dispenser in which a liquid (usually water) is supplied from a bottle to hot and cold discharge outlets via respective reservoirs. The cold reservoir of such a dispenser normally includes an outer casing of foamed heat insulating material, with cooling coils interposed between the insulation material and the wall of the reservoir. The hot reservoir contains an electrical heating element, and this too is commonly held in a casing of heat insulating foam to reduce heat loss.

There is a general trend towards reducing the volume of bottled liquid dispensers so that they occupy less space. On the other hand, the volume of the reservoirs should generally be as large as possible to maximize the volume of hot or cold liquid which can be dispensed without having to wait for the temperature to re-stabilize.

The present invention seeks to provide a new and inventive form of bottled liquid dispenser which allows the volume of the dispenser to be minimized whilst maximizing the internal liquid-containing space within the respective reservoir.

SUMMARY OF THE INVENTION

The present invention provides a bottled liquid dispenser in which liquid is supplied from a bottle to a discharge outlet via a reservoir containing a liquid space, wherein the reservoir is provided with thermal means and includes an inner wall and an outer wall defining a sealed and evacuated heat-insulating cavity at least partially surrounding the liquid space.

In one application of the invention the reservoir takes the form of a cooling vessel with the thermal means provided by a cooling coil. The invention may also be applied to reservoirs which form a hot tank with the thermal means provided by a heating element.

DEFINITIONS

It will be appreciated that terms such as "evacuated" and "vacuum" as used herein are intended to have their common meanings which pertain to a substantially reduced internal pressure rather than a total or absolute vacuum.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
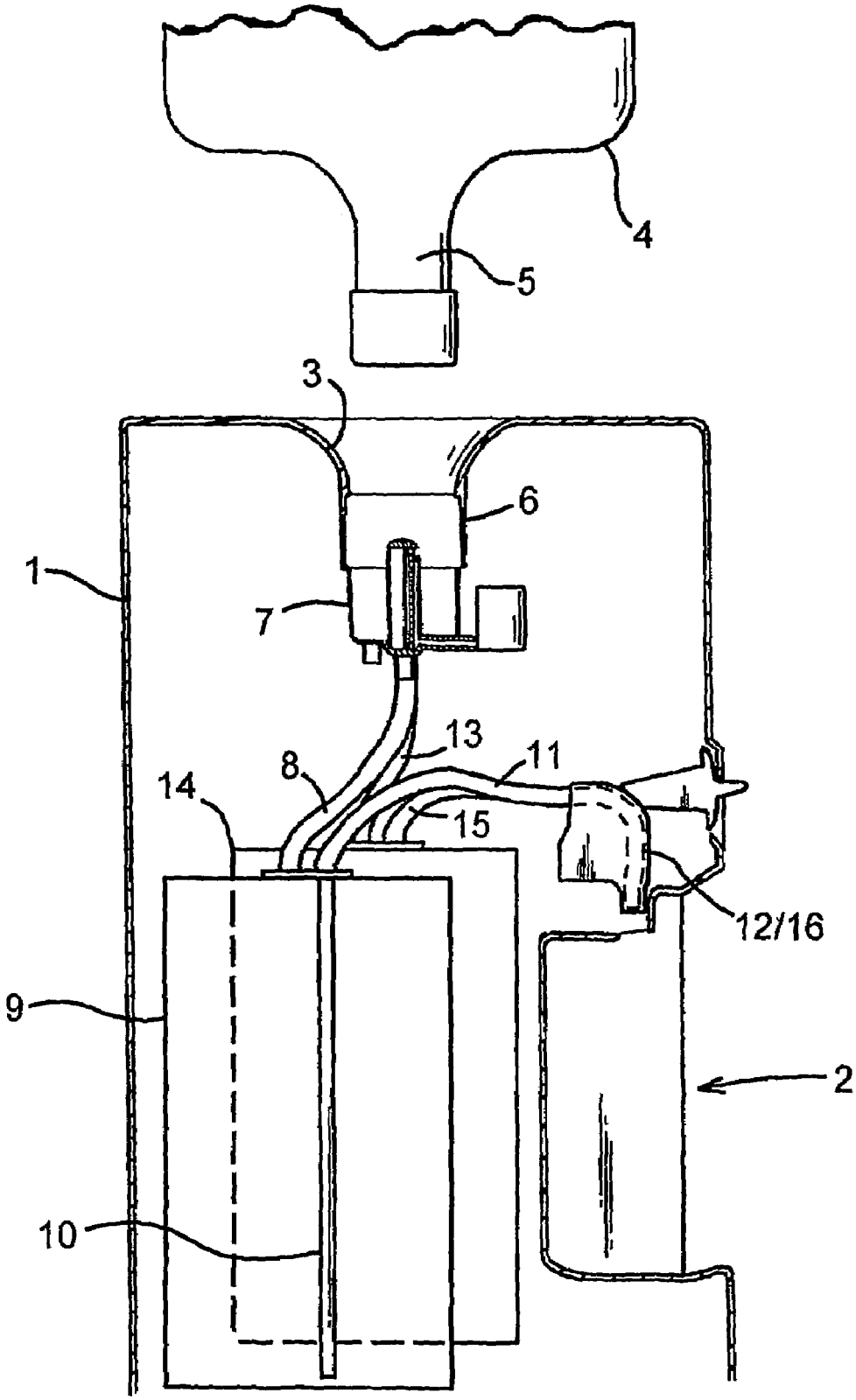
FIG. 1 is a general vertical section through a bottled water dispenser in accordance with the invention.

FIG. 1 shows a bottled water dispenser having a housing 1 with a dispensing recess 2 formed in its front wall. The top wall of the housing is formed with an annular seat 3 for supporting an inverted bottle 4 having a depending neck 5 which is received within a collar portion 6. A feed tube unit 7 is removably mounted below the collar portion 6 to conduct liquid from the bottle 4 via a flexible tube 8 to a cold reservoir 9 within the housing. A dip tube 10 conducts cooled liquid from the reservoir via an outlet tube 11 to a cold discharge valve 12 at the top of the recess 2. A second flexible tube 13 may be provided to conduct liquid from the feed tube unit 7 to a replaceable hot tank 14 so that hot water may be dispensed via a second outlet tube 15 and hot discharge valve 16 mounted alongside the cold valve 12.

Figure 2:
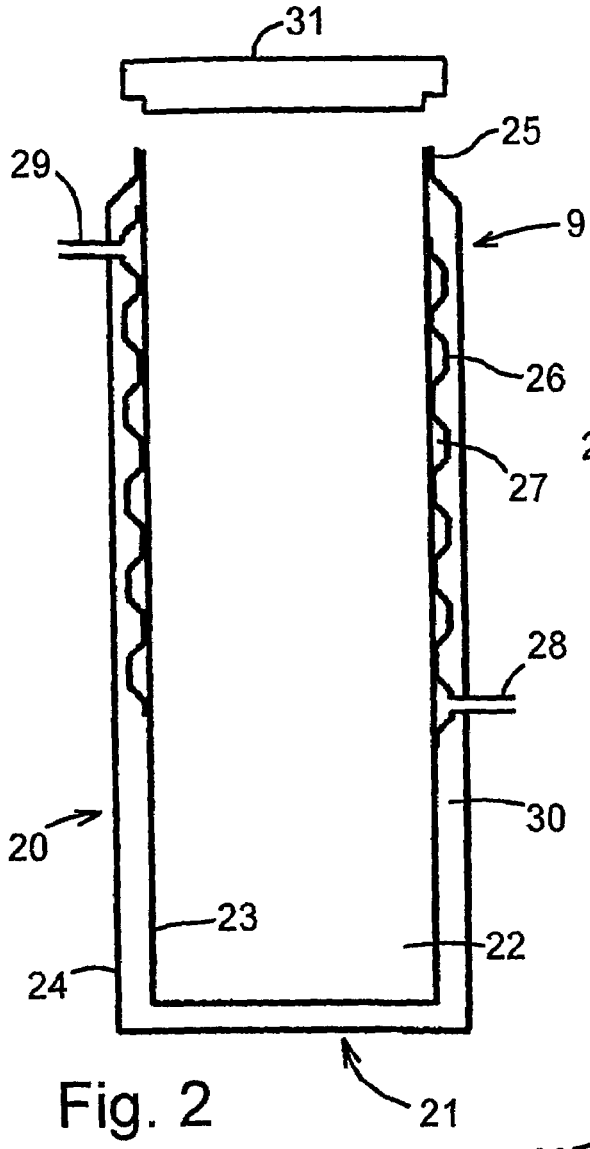
FIG. 2 is a vertical sectional view showing a first form of cold reservoir which may be used in the dispenser.

FIG. 2 shows a first form of the cold water reservoir 9, which may be fixed within the dispenser or provided as a replaceable unit which can be replaced periodically together with the feed tube unit 7 and associated tubes. The reservoir has sides 20 and a bottom 21 defining an internal fluid space 22, with spaced inner and outer walls 23 and 24 which are welded together at their upper ends to form an air-tight seal 25. An intermediate wall 26 is roll-bonded to the inner wall 23 to form a coiled duct 27 through which coolant fluid may be conducted between a first connection 28 and a second connection 29, both passing through the outer wall 24. The remaining cavity 30 between the inner and outer walls is evacuated to create a heat insulating space which surrounds the internal fluid space 22. The tubes 8 and 11 and the dip tube 10 are connected to a heat-insulating cap 31 which may, for example, be formed of foamed plastics material or evacuated inner and outer walls similar to the reservoir body.

Figure 3:
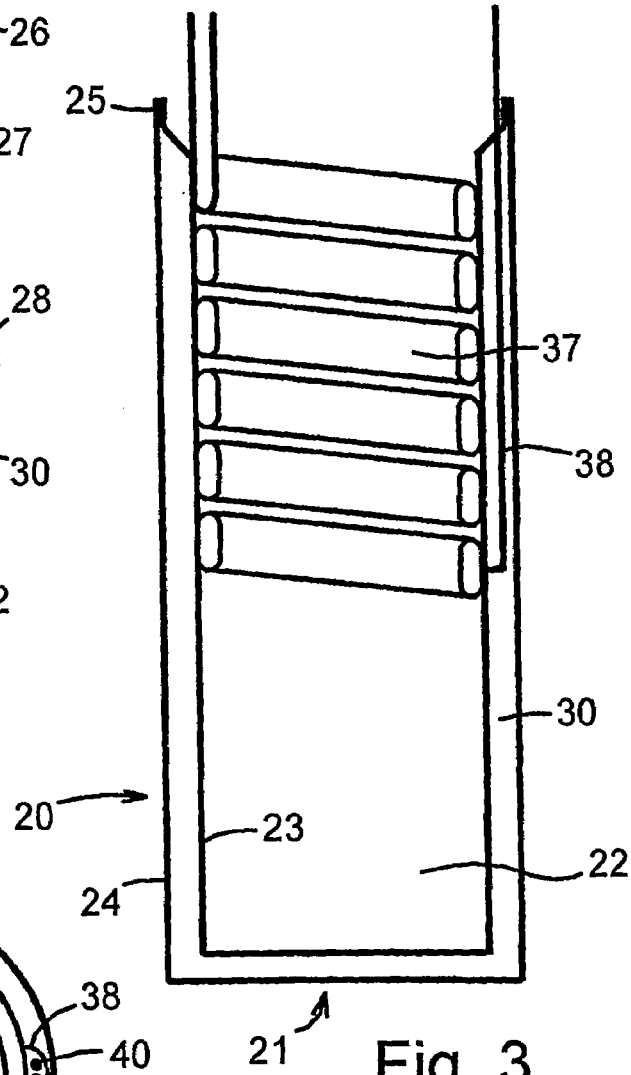
FIGS. 3 and 4 are vertical and horizontal sectional views showing another form of cold reservoir which may be used in the dispenser.
Figure 4:
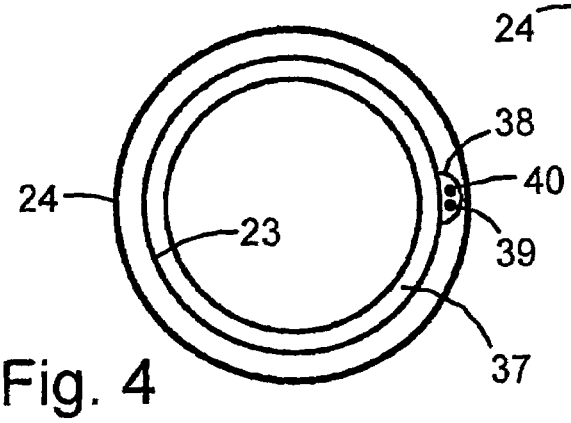

FIGS. 3 and 4 show another form of the cold water reservoir 9, which again, may be fixed or replaceable. Again, the reservoir has sides 20 and a bottom 21 formed by spaced inner and outer walls 23 and 24 sealed at their upper ends 25. The cavity 30 between the inner and outer walls is evacuated to create a heat insulating space surrounding the fluid space 22. In this embodiment a coiled refrigerant tube 37 is secured to the inner wall 23 within the upper portion of the fluid space 22. A vertical channel 38 is formed in the inner wall 23 to carry a capillary tube 39 which is connected to one end of the coil 37 and an optional temperature probe 40 for thermostatic temperature control of the reservoir contents. The reservoir may again be provided with a heat-insulating cap (not shown).

Figure 5:
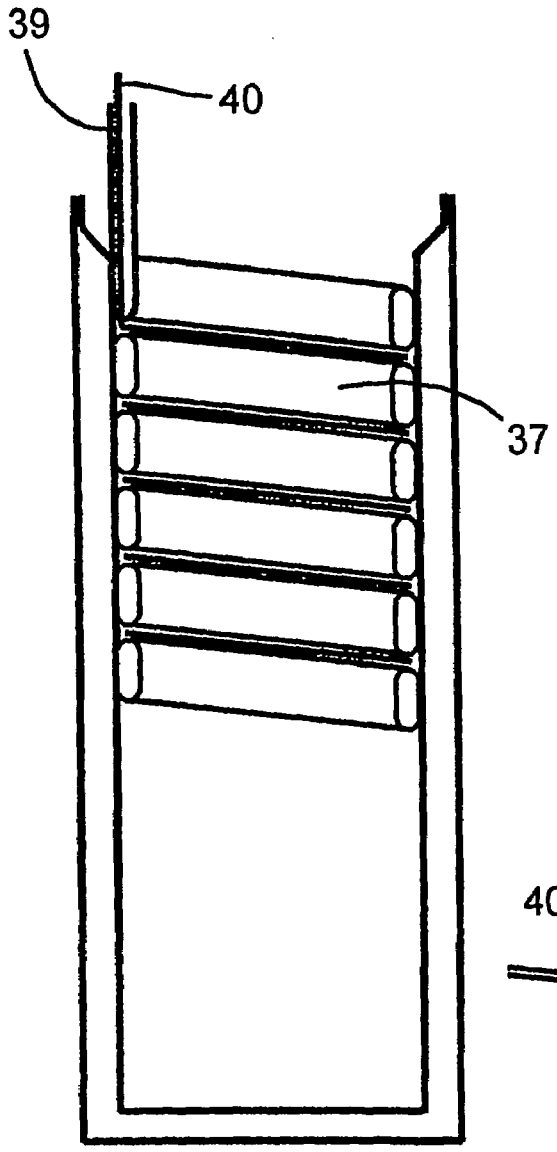
FIGS. 5 to 8 are vertical sectional views showing various alternative forms of cold reservoir.
Figure 6:
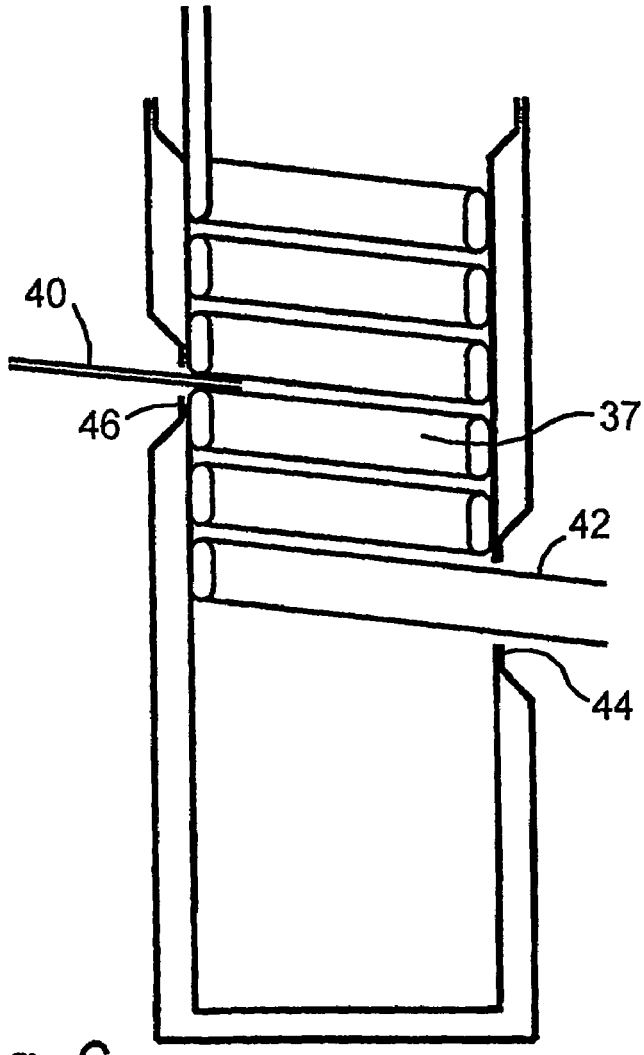

The cold reservoirs of FIGS. 5 and 6 are similar to the reservoir of FIGS. 3 and 4 except as follows. In FIG. 5 the capillary feed tube 39 and thermocouple probe 40 are routed hectically between the turns of the heat exchanger coil 37. In FIG. 6 the refrigerant connection 42 to the coil 37 passes through an sealed aperture 44 in the inner and outer walls 23 and 24. The temperature probe 40 may similarly be inserted through a sealed aperture 46.

Figure 7:
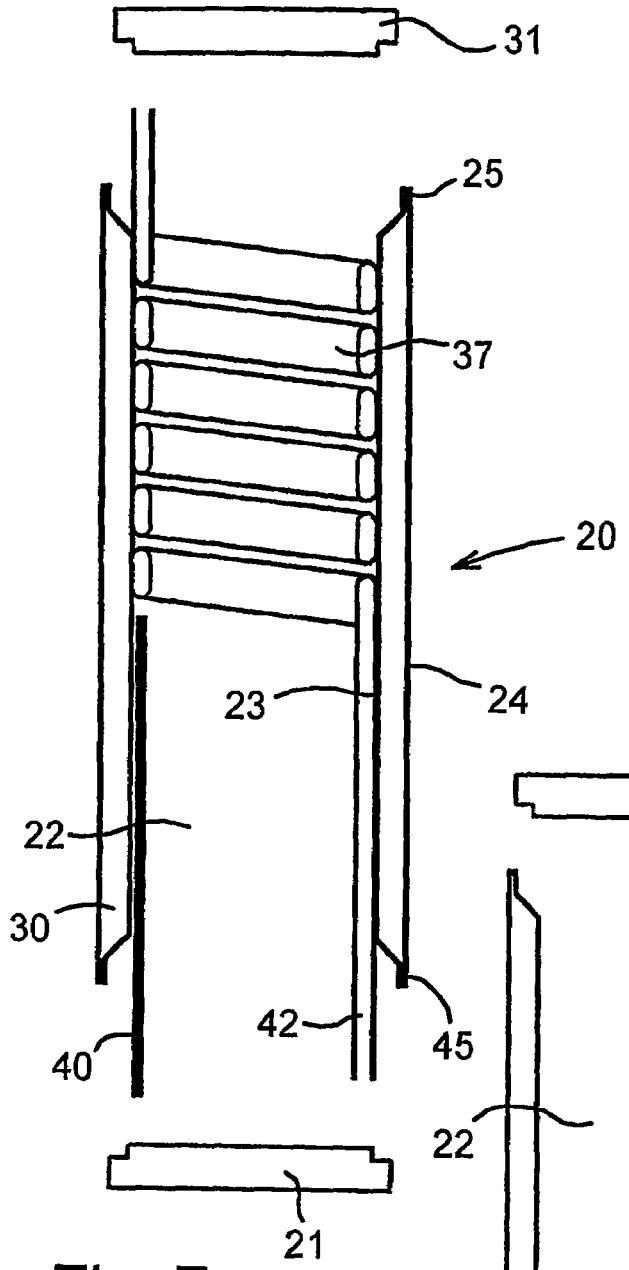

The cold reservoir which is shown in FIG. 7 may be fixed or replaceable. The sides 20 are formed by spaced inner and outer walls 23 and 24 sealed at their upper and lower ends 25 and 45. A separate bottom 21, which may, for example, be formed of foamed plastics material or evacuated inner and outer walls, is sealingly joined to the lower end of the sides 20. The cavity 30 between the two walls 23 and 24 is evacuated to create a heat insulating space surrounding the fluid space 22. A coiled refrigerant tube 37 is secured to the inner wall 23 within the upper portion of the fluid space 22, but in this case the lower connection 42 passes through the junction between the bottom 21 and the sides 20. A thermostat probe 40 may also be sealingly inserted between the bottom and side components. The reservoir may again be provided with a heat-insulating cap 31 as described.

Figure 8:
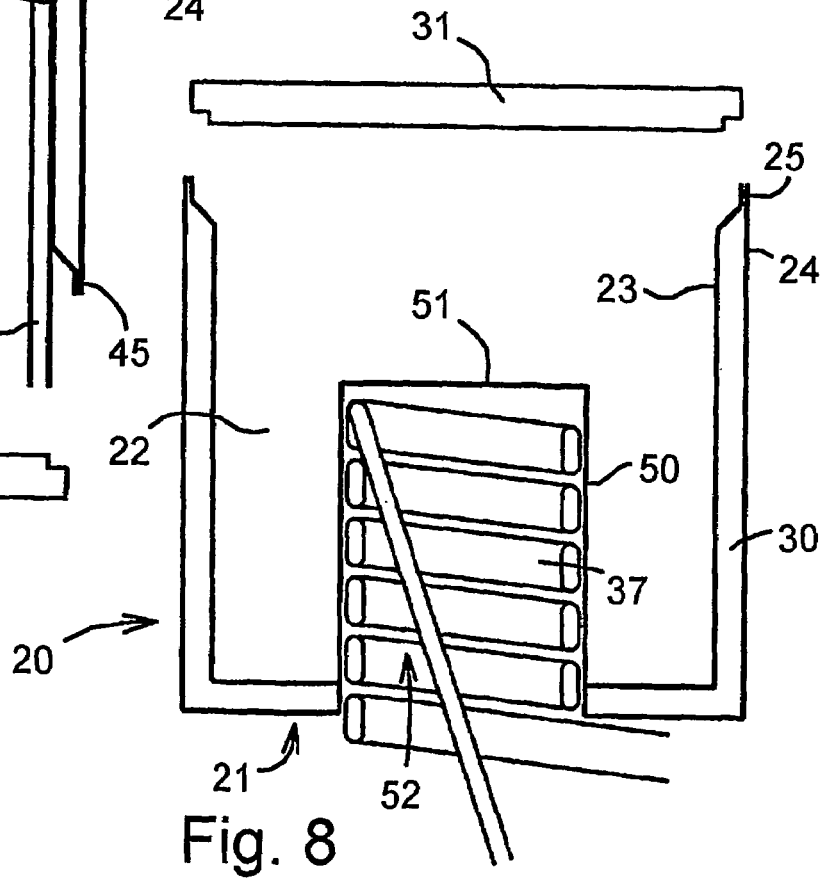

FIG. 8 shows another fixed or replaceable cold water reservoir 9 having sides 20 and an annular bottom 21 formed by spaced inner and outer walls 23 and 24 sealed at their upper ends 25 to form an intermediate evacuated space 30. In addition, the fluid space 22 within the side walls 20 contains an internal wall 50 which is closed by an upper end wall 51. The lower end of the internal wall is open and joins the inner margin of the annular bottom wall 21 forming a cavity 52 to receive the cooling coil 37. The reservoir may again be provided with a heat-insulating cap 31.

Figure 9:
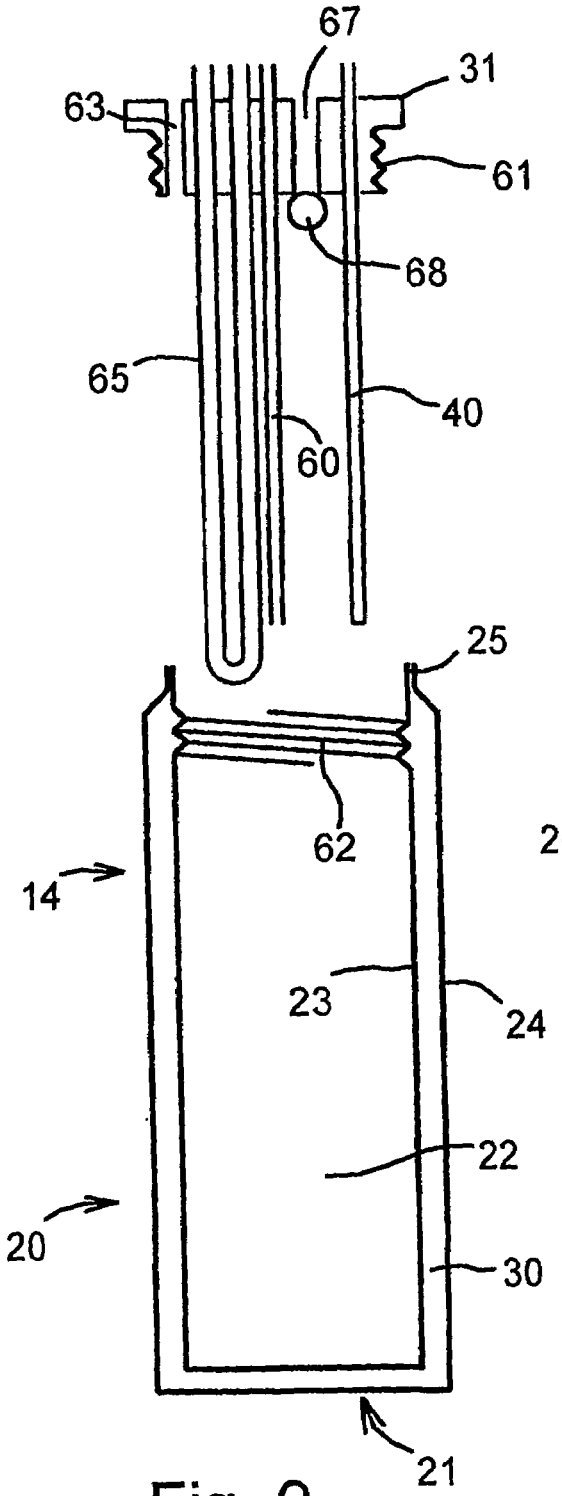
FIGS. 9 and 10 are vertical sectional views showing two forms of hot tank which may be used in the dispenser.

FIG. 9 shows a first form of the hot tank 14 which may be fixed within the dispenser or provided as a replaceable unit which can be replaced at intervals together with the feed tube unit 7 and associated tubes. The hot tank has sides 20 and a bottom 21 defining an internal fluid space 22, with spaced inner and outer walls 23 and 24 which are welded together at their upper ends to form an air-tight seal 25. The cavity 30 between the inner and outer walls is evacuated to create a heat insulating space which surrounds the internal fluid space 22. The water inlet tube 13 is connected to an inlet tube 60 which extends to the bottom of the space 22. The tube 60 is mounted in a heat-insulating cap 31 which may include evacuated inner and outer walls similar to the reservoir body. Alternatively the cap may contain foamed heat insulation material. In this example the cap 31 is secured to the reservoir side wall 20 by complementary screw threads 61 and 62. The cap has a hot water outlet aperture 63 for connection with the outlet tube 15, and an electrical heating element 65 projects into the liquid space 22. A temperature probe 40 may be inserted through the cap for temperature control. In order to prevent a buildup of pressure within the hot tank 14 a steam vent 67 may be provided, sealable by a float valve 68. Alternative forms of steam vent may be used such as an auxiliary port at the top of the inlet tube 60.

Figure 10:
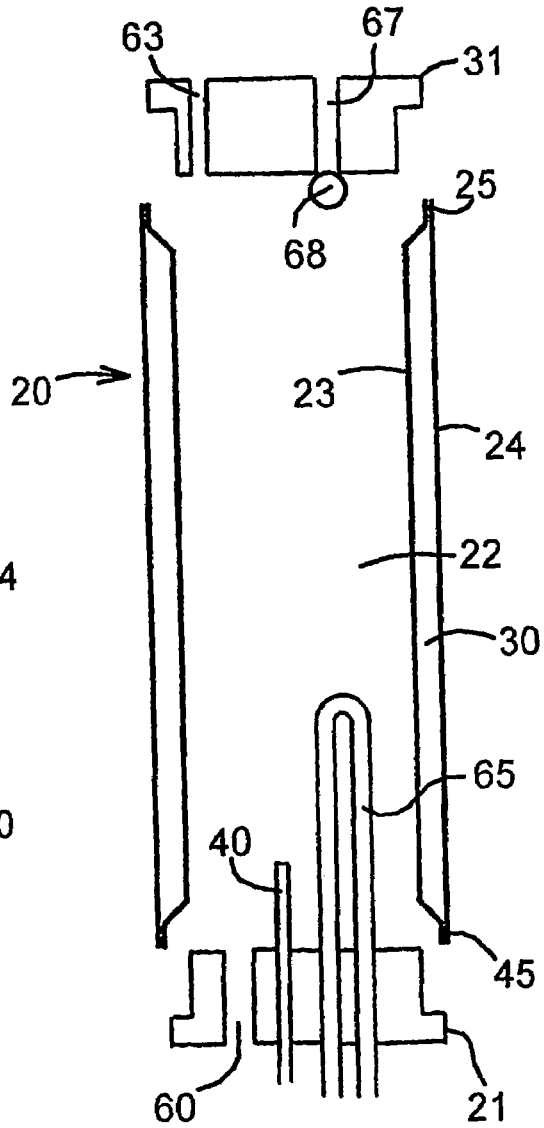

FIG. 10 shows another form of fixed or replaceable hot tank 14. The hot tank has sides 20 surrounding an internal fluid space 22, with spaced inner and outer walls 23 and 24 which are welded together at their upper and lower ends to form an air-tight seals 25 and 45. The cavity 30 between the inner and outer walls is evacuated to create a heat insulating space. The hot tank has heat-insulated top and bottom caps 31 and 21 which may include evacuated inner and outer walls or foamed heat insulation material. The water inlet tube 13 is connected to an inlet aperture 60 mounted in the bottom cap 21 while the top cap 31 has a hot water outlet aperture 63 for connection with the outlet tube 15. An electrical heating element 65 is also mounted in the bottom cap 21 to project into the liquid space 22 and a temperature probe 40 may also be inserted through the bottom cap for temperature control. To avoid a buildup of excess pressure within the hot tank 14 a steam vent 67 may be provided in the top cap 31 sealable by a float valve 68. Alternative forms of steam vent may again be provided.

The reservoirs described herein may be formed of metal (copper, aluminium etc.), plastic or glass for example. Moreover, they could be of any convenient transverse cross-sectional shape, e.g. oval or rectangular rather than round.

The caps 31 could be secured to the reservoir by bayonet fitting, screw threads etc, with or without an O-ring seal. The bottom caps 21 of FIGS. 7 and 10 could likewise be secured in a similar manner.

The reservoirs occupy significantly less space that a reservoir formed with conventional insulation materials, an 8 mm vacuum insulating wall being approximately equivalent to a 20 mm thick wall of foamed plastic. The fluid capacity of the reservoir may be maximized within a given space and the performance of the water dispenser is increased by reducing energy consumption and reducing the time required to achieve the desired water temperature.

It will be appreciated that the features disclosed herein may be present in any feasible combination. Whilst the above description lays emphasis on those areas which, in combination, are believed to be new, protection is claimed for any inventive combination of the features disclosed herein.

The invention claimed is:

1. A bottled liquid dispenser which includes housing with a dispensing recess and which defines a seat for receiving a bottle containing a liquid to be dispensed which is mounted on the seat in use, the housing containing a feed tube unit for engagement with the bottle to conduct liquid from the bottle to a discharge outlet in the dispensing recess via a reservoir within the housing, said reservoir containing a liquid space for holding the liquid and being provided with thermal means, an inlet through which liquid from the feed tube unit enters the liquid space, and an outlet through which liquid leaves the liquid space to flow to the discharge outlet, wherein the reservoir includes an inner wall and an outer wall at least partially surrounding the liquid space, in which the inner wall and the outer wall define a sealed and evacuated heat-insulating cavity and are joined together surrounding an opening which is closed by a cap, and said thermal means comprises a heating element which is held within the liquid space by said cap.

2. A bottled liquid dispenser according to claim 1 in which said inlet passes through the cap.

3. A bottled liquid dispenser according to claim 1 in which said inlet has an inlet opening located in a bottom region of the liquid space.

4. A bottled liquid dispenser according to claim 1 in which the outlet has an outlet opening located in a top region of the liquid space.

5. A bottled liquid dispenser according to claim 1 in which a steam vent is provided at the top of the reservoir.

6. A bottled liquid dispenser according to claim 1 in which said reservoir is provided with a temperature probe which is held within the liquid space by said cap.

* * * * *